US006724413B2

(12) United States Patent
Ng

(10) Patent No.: US 6,724,413 B2
(45) Date of Patent: Apr. 20, 2004

(54) IMAGE WIDTH CORRECTION FOR LED PRINTHEAD

(75) Inventor: Yee S. Ng, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/174,801

(22) Filed: Jun. 19, 2002

(65) Prior Publication Data

US 2003/0234855 A1 Dec. 25, 2003

(51) Int. Cl.[7] ..... B41J 2/45; B41J 2/385
(52) U.S. Cl. ..... 347/238; 347/130
(58) Field of Search ..... 347/238, 241, 347/256, 116, 133, 130; 399/44; 257/88; 359/820

(56) References Cited

U.S. PATENT DOCUMENTS 5,262,658 A * 11/1993 Jankowski ..... 257/88
5,313,333 A * 5/1994 O'Brien et al. ..... 359/820
5,585,836 A 12/1996 Pham et al. ..... 347/237
5,784,666 A * 7/1998 Nagase et al. ..... 399/44
5,973,718 A 10/1999 Charnitski et al. ..... 347/242

FOREIGN PATENT DOCUMENTS

JP 1-259692 * 10/1989 ..... H04N/9/09

* cited by examiner

*Primary Examiner*—Hai Pham

(57) ABSTRACT

Correcting pixel inaccuracies in a writing device having a linear array elements wherein a mechanism to control temperature within a predetermined portion of the writing device is used to correct placement inaccuracies by first determining the inaccuracies with respect to a centering element reference point, and then adjusting the temperature within the predetermined portion of the writing device.

7 Claims, 2 Drawing Sheets

IMAGE WIDTH CORRECTION FOR LED PRINTHEAD

FIELD OF THE INVENTION

The present invention is related to correction of pixel inaccuracy, and more particularly to correction for pixel inaccuracies in LED array printhead writers by thermal application.

BACKGROUND OF THE INVENTION

The prior art has numerous references that disclose array writers, such as marking engines that are used in printers and copiers. Among these array writers are light emitting diode (LED) writers that are typically arranged as a single linear array or as multiple linear arrays. LED arrays will generally have some inaccuracies in pixel placement. There are various sources for the inaccuracy in pixel placement such as inherent manufacturing tolerance of the LED array or variability within the lens array that is used with the LED array, each of which can result in image placement distortion. The LED array will form an image on a receiver that moves in a direction referred to as the in-track direction and the inaccuracies in the in-track direction are referred to as bow. The in-track direction is perpendicular to the line in which linear arrays are formed, referred to herein as the cross-track direction. Inaccuracies in the cross track direction are referred to as length precision and are measured in terms of deviations from the nominal length of the LED array. The LED elements as arranged can exhibit inaccuracies in both the in-track and the cross-track directions.

Tandem writers are typically used for color printing, with each writer being responsible for a different color. Inaccuracy in pixel placement causes registration errors between the writers. These placement errors commonly result in color-to-color registration errors. Some of the pixel placement errors are caused by the mechanical placement error in the LED printhead assembly process; others are caused by lens variability and distortion on the images. The lens arrays as referred to herein are of the type, or similar to, SELFOC® (a trademark of Nippon Sheet Glass Company, LTD) lenses. Improvements have been made in the mechanical placement of LED arrays that are used in LED printhead substrates. The sorting of lens alleviates a major distortion problem, however, the sorting procedures are time consuming. Mechanical adjustments of the lens also provides a solution to distortion problems by compensating for image distortion using mechanical adjustment mechanisms such as using screws in the lens mount as discussed in U.S. Pat. No. 5,973,718; 1999 entitled "Method and Apparatus to Correct for Active Write Length and Bow Changes in LED print bars", issued to Charnitski, et al. (Charnitski). Charnitski provides a degree of correction, however, the amount of correct is limited. Additionally, matching a lens to a printhead has been found to provide a reduction in color-to-color registration errors in tandem writers. Typically, these prior art methods can reduce the bow error ~30 to 40 $\mu$m in an A3 size printhead, but are still a time consuming process. Electronic bow correction has been discussed in prior art disclosures such as U.S. Pat. No. 5,585,836 entitled "Electrophotographic Image Recording Apparatus and Method with Correction for Bow in Placement of Recording Elements", issued to Pham, et al. in 1996. U.S. patent application Ser. No. 09/870,305 (commonly assigned with the present invention) entitled "Course and Fine Electronic Bow Correction for a Writer" in the name of O'Hara, et al., filed in May 2001, corrects pixel placement error in the in-track direction with a potential accuracy of better than 5–10 $\mu$m. However electronic bow correction only takes into account misplacement of pixel elements in the in track direction, and provides no assistance for the errors that exist in the pixel placement in the cross-track direction. Similar amounts of error can be seen in the cross-track direction of the image as well. Without excessive sorting, that results in a reduction in yield and increases cost significantly, alternative methods are needed to further improve the process.

From the foregoing discussion, it should be readily apparent that there remains a need within the art for an apparatus and process that provides for correction in array writers in a cross track direction without requiring the sorting of pieces used to make up the array writers.

SUMMARY OF THE INVENTION

The present invention addresses the aforementioned shortcomings within the prior art and corrects the inaccuracies in pixel placement in the cross track direction by intentionally distorting pixel locations after the printhead has been integrated with the lens and the cross-track pixel position has been measured.

These and other objects of the invention are provided by the two embodiments of the invention. The first embodiments uses an LED printhead having a substrate (ceramic or other substrate) attached to a thermal electric cooler via the heatsink. The temperature on the substrate can be raised or lowered, to increase or decrease the linear dimensions of the printhead to compensate for the pixel placement error in the cross track direction. Radiometric data of the pixels (with the lens) is calibrated so that uniformity correction can be performed with the whole system. The second method assumes that there is a thermal electric cooling device attached to the SELFOC® Lens mount, so the lens can be stretched or contracted thermally to compensate for errors in the cross track direction of LED printhead from the determined nominal length. Radiometric data is taken and uniformity correction performed. The above method can be combined with the electronic bow correction of the in track direction to yield much better total pixel placement accuracy in both the cross track and in track directions and increase manufacturing yield with little sorting.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The present invention provides for correcting inaccuracies in pixel placement within LED writers that can cause color-to-color registration errors printers, and the like that employ tandem (more than one) writers. There are two embodiments proposed for the present invention that provide intentional distorting of an LED writer in the cross track direction to compensate for inaccuracies in writer length.

Figure 1:
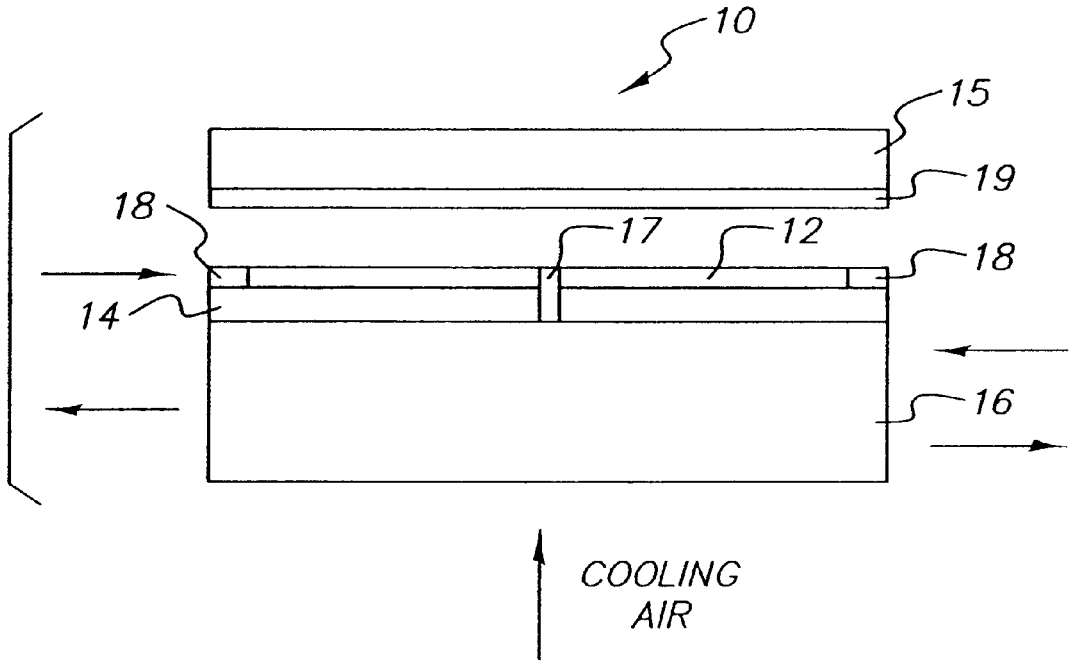
FIG. 1 is a diagram illustrating the first embodiment of the invention.

The first embodiment is illustrated in FIG. 1. A substrate 12 (ceramic or other substrate), for the LED printhead 10, is attached to a thermal electric cooler 14, which is in turn attached to a heatsink 16. The temperature on the substrate 12 can be raised or lowered to increase or decrease the linear dimension of the LED printhead 10 to compensate for any pixel placement error in the cross direction. The radiometric data for the pixels (with the lens) is calibrated so that uniformity correction can be performed with the whole system.

Figure 2:
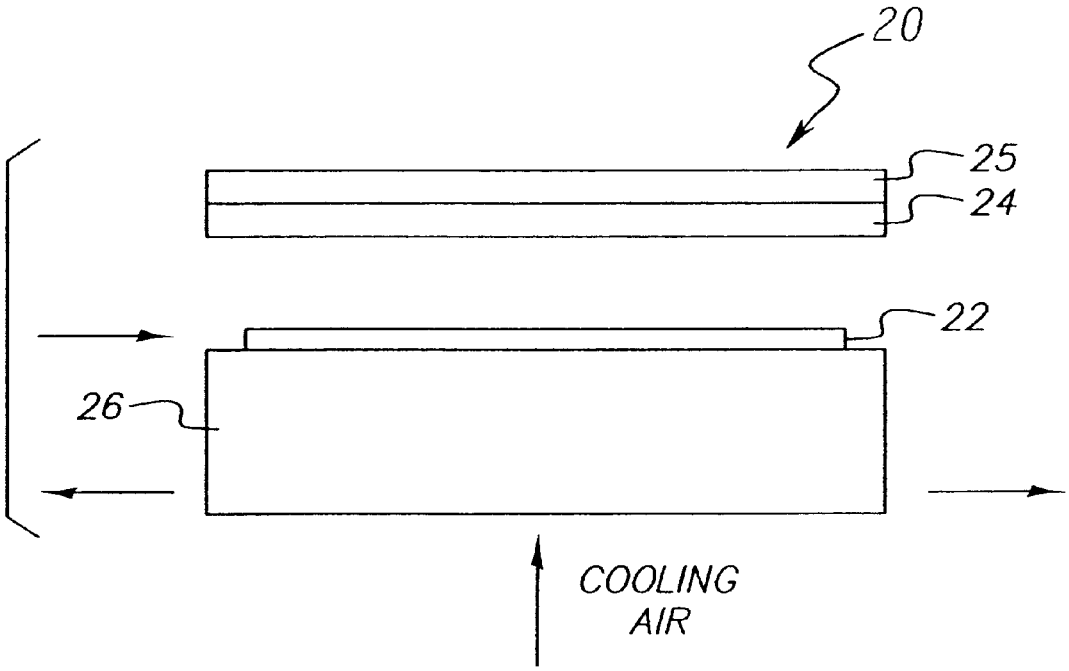
FIG. 2 is a diagram illustrating the second embodiment of the invention.

FIG. 2 illustrates the second embodiment wherein the thermal electric cooler 24 is attached to the mount of the SELFOC® Lens 25, so the lens can be stretched or contracted, as controlled by the thermal electric cooler 24, to compensate for inaccuracies in the cross track direction of the LED printhead 20 from the nominal length. Then radiometric data is taken to perform uniformity correction.

In order to perform uniformity correction, for either of the embodiments illustrated in FIG. 1 or FIG. 2, radiometric data is first taken. The initial position calibration is done with the temperature of the thermal electric cooler (element 14 or 24) set to a nominal operating temperature in the printer (for example, 30° C.), and then obtaining the pixel position data. Then the thermal electric cooler temperature is adjusted to expand or contract the writer substrate (element 12 as described in the embodiment for FIG. 1 above), or distort the lens via thermal-mechanical means (as described in the embodiment for FIG. 2 above) to compensate for writer length differences. The radiometric data on the image plane is obtained and the exposure uniformity correction can be accomplished based on this data. The above method can be combined with the electronic bow correction in the in track direction to yield much better total pixel placement accuracy in both the in-track and cross-track directions and increase manufacturing yield without requiring significant sorting.

Referring again to FIG. 1, the first embodiment for compensation of an LED writer, assume that the writers (printhead 10 including SELFOC® Lens arrays 15) has pixel locations determined by a standard pixel position scanning done at a predetermined temperature (preferably 30° C.). Assuming further that the substrate 12 (the LED arrays are mounted on top of the substrate) of the LED printhead 10 is mounted on a series of thermal electric coolers 14, and the thermal electric coolers are mounted on a heatsink 16. Further assume that heatsink 16 is cooled by conventional forced air-cooling (external air temperature can also be controlled to minimize stress). The ceramic substrate 12 and thermal electric cooler 14 have a center hole/pin 17 construction that allows the ceramic substrate 12 to expand or contract (with respect to the center pins on the heatsink) thermally. The term center hole/pin 17 as used herein can refer to either a hole, a pin, or a combination of a hole and pin. A temperature controller (not shown) can be used to raise or lower the temperature of the thermal electric cooler/printhead substrate in order to achieve expansion or contraction of the LED arrays. As a further example of the invention, by employing a ceramic substrate 12 that matches the thermal expansion coefficient of the LED material (GaAs), typically, a total change of 29 $\mu$m in the LED printhead having a nominal length of about 14 inches is achievable with a temperature change of 15° C. The total change of 29 $\mu$m is achieved from the center hole/pin 17 construction viewpoint as illustrated in FIG. 1 by altering the temperature +/−7.5° C. from a nominal temperature of 30° C. resulting in change of +/−14.5 $\mu$m. This change of +/−14.5 $\mu$m is arrived at from center hole/pin 17 viewpoint by a +/−7.25 $\mu$m length change from either side of the pin with the total length change of +/−14.5 $\mu$m. This change of +/−14.5 $\mu$m can be achieved with a change in temperature that has a range of 15° C. (+/−7.5° C. from a nominal temperature of 30° C.). Accordingly, a writer having errors on the order of ~40 $\mu$m maximum in the cross-track direction can be substantially reduced by thermally expanding or contracting the LED array to match a nominal writer length after the length measurement is finished. In the foregoing example the center hole/pin 17 is envisioned to be about 1 mm in diameter. The preferred embodiment also provides that the LED printhead 10 be constructed using one linear LED array driven by two sets of drivers, one driver for even numbered pixels and another driver for odd numbered pixels. It is also provided that the printhead pixel brightness will be measured at that preset compensation temperature which is the same 30° C. temperature used during the standard pixel position scanning, and uniformity correction will be done based on the radiometric measurement. The center hole/pin 17, shown in FIG. 1, operates to fix the center location of the ceramic substrate upon which the LED arrays are mounted, so any thermal expansion is therefore, relative to the center location.

In the case of the second embodiment as shown in FIG. 2, the substrate 22 together with the heatsink 26 for the LED printhead 20 are mounted and cooled conventionally, however the mount for the SELFOC® Lens 25 has a separate thermal electric cooler 24 attached to it. After the pixel position measurements are done with the writer at the nominal 30° C. temperature used during the standard pixel position scanning, the thermal electric cooler 24 can be used to raise or lower the temperature of the lens stiffening bar to effect a change in the length of the stiffening bar that is transmitted to the SELFOC® Lens 25 by mechanical and thermal forces.

FIG. 2 illustrates a substrate 22 containing the LED array on top of heatsink 26. The lower portion of the SELFOC® Lens 25 is mounted on thermal electric cooler 24. Variations in the temperature of thermal electric cooler 24 exert a lateral (cross-track) force across the entire SELFOC® Lens 25 that operates to distort the lens mechanically and optically. Thermal electric cooler 24 with heatsink 26 is attached to the lower portion of the lens mount, which then exerts a lateral (cross-track) force across the lower portion of the lens to distort the lens mechanically and optically in the cross-track direction. Other embodiments could have the thermal electric cooler 24 attached to the upper portion of the lens mount which would then exert a lateral, cross-track force across the upper portion of the lens to mechanically and optically distort the upper portion of the lens in a cross-track direction. These distortions are intentionally created to correct for the writer length deviation from the nominal length. There are inherent advantages in this distortion methodology in that the lens is a passive device, so the lens system is less subject to printing image load change and a smaller thermal electric cooler is typically required. The lens system is unlike the LED printhead where the substrate for the LED printhead has to cool an active device—the LED emitter array. Other embodiments may choose to use a stiffener material (such as Steel) that has a higher thermal expansion coefficient than the GaAs, so a larger optical length change is achieved with a smaller change in temperature on the stiffening bar, and reduce the length error of writers effectively.

The invention specifically envisions that a combination of the writer optical length control (cross-track direction) with the electronic bow correction (in track direction) to achieve much better color to color registration of writers in a high speed tandem printer with multiple writers.

Figure 3:
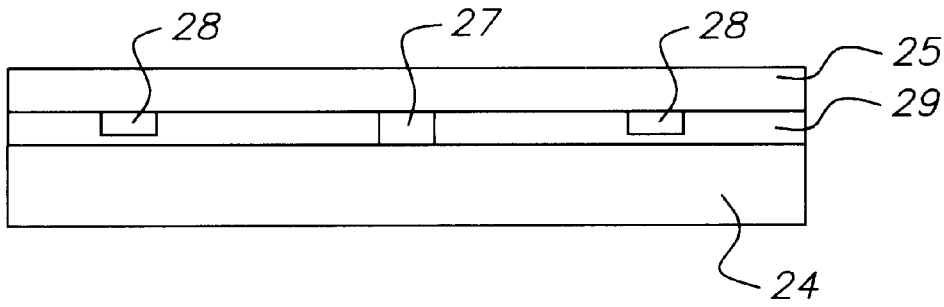
FIG. 3 is a view of a lens with a stiffening bar assembly.

FIG. 3 illustrates the preferred stiffening bar 29 that can be used as a lens mount for the embodiment of FIG. 2. In this configuration, the thermal electric cooler 24 and the stiffening bar 29 are also set to nominal temperature for scanning. The intent of the preferred embodiment is to modulate the temperature on the lens via the stiffening bar, without modulating the temperature on the rest of the system. Therefore, it may be desirable to isolate the assembly of the thermal electric cooler mounted on the stiffening bar from the rest of the system. The embodiment illustrated in FIG. 3 has SELFOC® lens 25 mounted on thermal electric cooler 24, therefore, the stiffening bar 29 contains the centering locator 27 which is functionally equivalent to the center hole/pin 17 of the first embodiment. By placing the centering locator 27 on the stiffening bar 29, temperature changes in thermal electric cooler 24, result in spatial changes in thermal electric cooler 24 that are transferred as mechanical and thermal forces through thermal couplings to the SELFOC® lens 25 and operate to change the focus attributes of the SELFOC® lens 25.

Referring to FIG. 3, which is a detailed view an embodiment of the SELFOC® lens 25 with stiffening bar 29 used as a lens mount. The invention uses thermal couples 28 attached to the SELFOC® lens 25 and the stiffening bar 29, the thermal couples 28 being used because the SELFOC® lens 25 is a good thermal isolator. The thermal couples 28 not only assist in the transfer of heat but also transfer the spatial changes that occur in thermal electric cooler 24, with changing temperature to the SELFOC® lens 25, as an application of mechanical forces. Here, the use of mechanical forces as applied by the invention that change the optics of the system can clearly be seen to contrast with that correction techniques as described in U.S. Pat. No. 5,973,718. U.S. Pat. No. 5,973,718 applies mechanical forces through a screw mechanism to correct bow, but also effects a change in writer length. The invention described herein applies mechanical forces as a result of controlling temperature in thermal electric cooler 24, and transfers resulting spatial changes in thermal electric cooler 24 to the lens 25. The intent is to either heat or cool the stiffening bar 29, which is preferably steel, and in turn mechanically distort portions of the lens, thereby creating slight optical contraction (magnification) to the pixels on the image plane.

The embodiment illustrated in FIG. 1 can also employ a stiffening bar 19 as a lens mount for SELFOC® lens 15. Here, the assembly containing SELFOC® lens 15 and stiffening bar 19 are attached to the thermal electric cooler 14 via thermal couples 18 as shown in FIG. 1. Changes within the thermal electric cooler 14 will stress the stiffening bar 19 evenly. Thermal couplings 18 are applied to the embodiment of FIG. 1 to allow the stress in the stiffening bar 19 to be transmitted to the SELFOC® Lens through application of thermal and mechanical forces.

Figure 4:
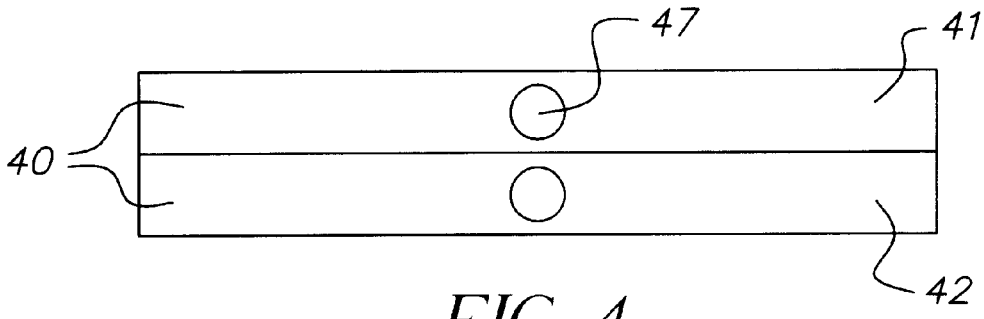
FIG. 4 is a top view of the invention.

FIG. 4 illustrates a top view of a variation of the embodiment shown in FIG. 1. As previously stated, with the embodiment in FIG. 1, the LED printhead 10 is constructed with one linear LED array driven by two sets of drivers, one for even number pixels and another for odd numbered pixels. FIG. 4 illustrates a top view having two linear LED arrays 40, a first odd pixel row 41 and a second even pixel row 42. Each of the LED arrays 40 employs a center pin 47 according to the above described center/hole pin construction. The invention can be constructed using one linear array driven by one set of drivers (single-sided drivers), by one linear array using two sets of drivers (double-sided drivers), or alternatively, multiple LED arrays driven by a set of multiple drivers.

Many types of thermal couplings are suitable for use to transport temperature variations throughout the foregoing systems of the invention. The most inexpensive implementation of a thermal coupling is to use a single stiffening bar and one thermal electric cooler. The most effective manner of thermal coupling would employ multiple stiffening bars on the lens and multiple thermal electric coolers. Other embodiments could use two stiffening bars on the lens, with the thermal electric cooler on one of the stiffening bars and a thermal coupling (such as copper braid) to thermally connect the two stiffening bars.

Once the thermal couplings in any of the above related embodiments are implemented, both thermal and mechanical forces are transmitted to the lens. The relative amount of thermal and mechanical force depends on the embodiment employed. Temperature variation is conducted to the lens as a function of thermal conductivity of the thermal couples. One function of the stiffening bar is to couple the mechanical distortion onto the lens, the other function is to transmit the temperature to the lens to make it expand.

The foregoing description describes the preferred manner of thermally inducing distortion within the lens 25 by using a stiffener that stresses the lens more uniformly (evenly) than using mechanical screws that twist the lens at one point. Other embodiments that thermally stress portions of the writer will be readily apparent to those skilled in the relevant arts. Additionally, techniques can be employed that will provide relatively uniform stress to portions of the writer, such as employing a piezoelectric material to stress the writer in a desired area to correct writer length inaccuracies.

The foregoing description details the embodiments most preferred to the inventor. Variations in the foregoing embodiments will be readily apparent to those skilled, therefore, the breadth of the invention should be measured by the appended claims.

Parts List

10 printhead
12 substrate
13 LED array
14 thermal electric cooler
15 lens
16 heatsink
17 center hole/pin
18 thermal couple
19 stiffening bar
20 printhead
22 substrate
24 thermal electric cooler
25 lens
26 heatsink
28 thermal coupling
29 stiffening bar
40 array
41 odd row
42 even row
47 centering pin

What is claimed is:

1. An array writer with length correction comprising:

a plurality of writing elements formed in a first direction within said array writer, and a centering device located within said writing elements;

a temperature controlling device within said array writer; and an interface between said writing elements and temperature controlling device to allow for temperature control of writing placement inaccuracies with respect to said centering element.

2. The array writer of claim 1, further comprising a lens being operatively configured to said plurality of writing elements.

3. The array writer of claim 2, further comprising at least one thermal coupling between said lens and said temperature controlling device.

4. The array writer of claim 3, wherein said thermal coupling is operative to transfer mechanical forces from said temperature controlling device to said array writer.

5. The array writer of claim 2, further comprising said writing elements being formed on a substrate having said lens attached to a first side of said substrate and said temperature controlling device attached to a second side of said substrate opposite said first side.

6. The array writer of claim 2, further comprising said writing elements being formed on a substrate having said temperature controlling device attached to a first side of said substrate with said lens attached to said temperature controlling device and a second side of said substrate opposite said first side being attached to a heatsink.

7. The array writer of claim 1, wherein said writing elements further comprise plural rows of said writing elements.

* * * * *